US005234033A

United States Patent [19]

Stoll et al.

[11] Patent Number: 5,234,033

[45] Date of Patent: Aug. 10, 1993

[54] FLUID POWER VALVE UNIT

[75] Inventors: Kurt Stoll, Esslingen; Jürgen Schnatterer, Filderstadt, both of Fed. Rep. of Germany

[73] Assignee: Festo KG, Esslingen, Fed. Rep. of Germany

[21] Appl. No.: 957,635

[22] Filed: Oct. 6, 1992

Related U.S. Application Data

[63] Continuation of Ser. No. 759,859, Sep. 16, 1991, abandoned, which is a continuation of Ser. No. 498,022, Mar. 23, 1990, abandoned.

[30] Foreign Application Priority Data

Apr. 5, 1989 [DE] Fed. Rep. of Germany ..... 3910913

[51] Int. Cl.[5] ..... F16K 11/00

[52] U.S. Cl. ..... 137/884; 439/65; 361/785

[58] Field of Search ..... 137/860, 864, 407.1; 439/65, 67, 717; 361/412, 413, 414

[56] References Cited

U.S. PATENT DOCUMENTS

| | | | |
|---|---|---|---|
| 4,445,536 | 5/1984 | Willis | 137/560 |
| 4,557,292 | 12/1985 | Nicolas et al. | 137/596.16 |
| 4,728,215 | 3/1988 | Martinici | 403/407.1 X |
| 4,785,848 | 11/1988 | Leiber | 137/884 X |
| 4,790,762 | 12/1988 | Harms, deceased et al. | 439/65 X |
| 4,815,496 | 3/1989 | Nishitani et al. | 137/560 X |
| 4,883,383 | 11/1989 | Challis | 403/407.1 |
| 4,889,164 | 12/1989 | Hozumi et al. | 137/884 X |
| 4,938,258 | 7/1990 | Sato | 137/560 X |
| 5,000,226 | 3/1991 | Stoll et al. | 137/884 |

FOREIGN PATENT DOCUMENTS

| | | | |
|---|---|---|---|
| 0057078 | 4/1985 | Japan | 137/884 |
| 0104876 | 6/1985 | Japan | 137/884 |
| 0143284 | 7/1985 | Japan | 137/884 |
| 2098665 | 11/1982 | United Kingdom . | |
| 2130440 | 5/1984 | United Kingdom . | |

*Primary Examiner*—John C. Fox

*Attorney, Agent, or Firm*—Flynn, Thiel, Boutell & Tanis

[57] ABSTRACT

A fluid power valve unit with at least one electromagnetic actuating block on a valve block which is adapted to be connected with a connection block having fluid power ducts therein. This connection block has means for connection with further connection blocks and contains electrical power and/or control conductors therein, and a plug connecting device connected with these conductors is respectively arranged on those sides of the connection block, which come into engagement with corresponding sides on connection with further connection blocks. Furthermore there are electrical connecting devices for the conductors in the connection block and connection of same with electrical terminals of the at least one actuating block. It is thus possible to dispense with wiring using separate wire elements on the valve unit even in the case of a number of such units being plugged together in rows, the electrical connections also being automatically produced on plugging together.

23 Claims, 3 Drawing Sheets

FLUID POWER VALVE UNIT

This application is a continuation of U.S. Ser. No. 07/759,859, filed Sept. 16, 1991, now abandoned, which was a continuation of U.S. Ser. No. 07/498,022, filed Mar. 23, 1990, now abandoned.

FIELD OF THE INVENTION

The invention relates to a fluid power, that is to say pneumatic or hydraulic power, valve unit comprising a valve block which bears at least one electromagnetic actuating block and is adapted for connection with a connection block having fluid power ducts, said connection block having means for connection with further connection blocks.

BACKGROUND OF THE INVENTION

Such connection blocks and valve blocks connected therewith are commonly connected together in the form of long rows alongside each other with the connection blocks being connected with each other and at least partly containing the fluid power supply ducts for instance. For actuation of the valve blocks it is necessary for the associated actuating blocks to be provided with electrical connection cables. It is more especially in the case of long rows of such valve blocks where pulse valves for instance may in addition have two respective electromagnetic actuating blocks, that a very elaborate, untidy-looking wiring system comes into being, which makes servicing and fault finding a very time-consuming operation. Later modification of the control wiring for redesigning such an installation is also very complex and slow. A further point is that there is the danger that the electrical wiring arranged more or less loosely on the exterior of the blocks may be pulled off or otherwise damaged by mechanical contact with relatively moving structures. The replacement of one type of valve by another generally makes necessary a new design for the wiring.

SHORT SUMMARY OF THE PRESENT INVENTION

One object of the present invention is to devise a valve unit of the initially mentioned type which does not have any externally arranged connection leads.

A further object of the invention is to provide such a valve unit such that the attachment of new blocks may be performed with the substantially automatic production of the electrical connections.

In order to achieve these or other objects appearing in the present specification, claims and drawings, electrical power supply and/or control lines extend in the connection block, plug connection devices connected with these lines are arranged on those sides of the connection block which on connection with further connection blocks come into engagement with corresponding sides thereof and electrical connecting means for the lines in the connection block are provided with electrical terminals of the at least one actuating block. There are advantages more especially since on the application of a further connection block , owing to the plug connection means, the electrical conductors are automatically guided in to the new connection block without any necessity for a special adaptation of the wiring. The conductors extend within the connection blocks and are thus protected against damage. It is possible to individually determine which of the many conductors introduced into the connection in this manner are to be connected with the associated actuation block. The insertion of the conductors into the respective connection block is not influenced by this in any way. For this reason it is possible to replace items on such a valve block after completion of manufacture without any wide-ranging alteration of the wiring being needed.

Further features and developments of the invention are described in the claims.

In accordance with a particularly simple further feature of the invention the conductors, which are more especially in the form of printed wiring are carried on a printed circuit board, in the case of which two opposite side edges carry plug connection devices and/or are designed in the form of plug connection devices. In this manner it is possible to arrange a very large number of conductors exactly in such a manner that they may be easily visually checked, the plugging together with a further connection block or suitable printed circuit boards meaning that the conductors are continued in the further connection block or blocks. Such a printed circuit board is readily produced and may be inserted into the connection block and may if necessary be later replaced after the valve unit has been mounted in the equipment it is designed for.

It is convenient if the one plug connection device is in the form of a multiple male plug connector and the other plug connection device is in the form of a corresponding female plug connector, one of the connectors and more especially the multiple male one projecting out of the connection block. When the connectors are joined together the projecting multiple male connector will fit into the corresponding female connector on the circuit printed circuit board in the next connection block. The multiple male connector may simply be formed by portions of the printed wiring.

By accommodating the printed circuit board in passages through the connection block it is possible to ensure simplicity of insertion and replacement of the printed circuit boards.

The printed circuit board in addition possesses control connection contact means for the electrical connecting means leading to the actuating block, at least two of the conductors being connected, or being able to be connected, with these control terminals. It is in this manner that it is possible to ensure simple correspondence of the terminals for the respective actuating block with given conductors on the printed circuit board.

In order to make possible the creation of uniform printed circuit boards for all connection blocks the contact means of the plug connection devices are arranged along the lateral edges of the printed circuit board in a juxtaposed manner, and for transmission of the potential of one of the operating voltage poles one of these contact means is connected with the directly opposite contact and with one of the control terminal contact means, whereas the remaining contact means are respectively connected in an offset manner with the opposite contact means, one of the two outer contact means being connected with a second one of the control terminal contact means. This ensures that each of the conductors extending from one printed circuit board to the next is always connected with only one given actuating block, and the order of the contact means, arranged side by side, of the first printed circuit board is in agreement with the order of the valve blocks. This ensures that there is an unambiguous association in a simple manner and in the case of a modification of the terminal conducts being necessary it is only necessary to connect the particular contact means of the first printed circuit board with a new control conductor.

The possibility of providing an even more customized design still using standard, uniform printed circuit boards is possible if the contact means of the plug connecting devices are arranged along the side edges of the printed circuit board in a juxtaposed manner, and the contact means on the one side edge are connected with the correspondingly arranged contact means on the other side edge via the printed wiring, and one of the printed conductors is connected with the correspondingly arranged contact means on the other side edge via the printed wiring, and one of the printed conductors is connected with one of the control terminal contact means for transmission of the potential of one power supply pole, white at least a second contact means of the control terminal contact means is able to be connected with one of the remaining printed conductors via a multi-way switch device. This multi-way switch may be in the form of a linear or rotary switch. This makes it possible to provide a simple way to modify the association of the control terminals, even after manufacture is completed, on an actuating block with respect to one of the printed conductors, to interrupt such association or to modify the same. This design also makes it possible to connect a plurality of actuating blocks with the same printed conductor, that is to say to connect them in parallel. For later modification of the association with one of the electrical supply conductors it is preferred to provide an opening in the housing of the connection block for access to the linear or rotary multi-way switch. Given a suitable design of the printed circuit board, this opening in the housing may also be used for later replacement of printed circuit boards.

In accordance with a particularly advantageous design the electrical connecting means for use with the electrical terminals of the actuating block are also in the form of a printed circuit board. This means that it is possible to dispense with all separate conductors. This printed circuit board is arranged between the valve block and the connection block and has a part projecting past as far as the terminal contact means of the at least one actuating block. If there are two opposite actuating blocks there are then two projecting parts. This arrangement ensures that the printed circuit board is simultaneously fixed to the connection block at the time of assembly of the valve block. Connecting conductors, preferably designed in the form of printed conductors on the printed circuit board, are connected with a plug connection device projecting towards the connection block, the plug connection device inserted into a corresponding hole in the connection block being able to be pluggingly connected with the control terminal contact means of the other printed circuit board. The result is that the necessary terminals are automatically plugged or slipped on by slipping this printed circuit board onto the connection block so that the two printed circuit boards are able to e pluggingly connected together in a configuration in which they are perpendicular to each other.

It is advantageous if the projecting part has a plug connection device which may be connected with plug connection devices on the actuating block so that on plugging or slipping on the valve block having at least one actuating block on the connection block all the electrical connections are produced at the same time.

The plug connection devices on the actuating block are preferably in the form of plug contact means fitting into the printed circuit board and the plug connection devices on the printed circuit board are preferably in the form of suitably designed contact openings so that on the whole the result is a very simple and moderately priced plug connection device arrangement.

The plug connection devices on the printed circuit board are preferably surrounded by a sealing element, preferably made of elastomeric material able to be inserted into the printed circuit board in order to protect the said contact means against moisture, effects of the environment and damage by touching.

In order to provide for rapid and reliable assembly of the connection blocks with each other, of the two opposite sides, of each connection block, which are able to be engaged with corresponding sides of further connection blocks, the one side is provided with projecting retainer elements having a retainer head and the other side has openings to receive corresponding retainer elements of a further connection block, the openings coming to an end at rotary elements set in the connection block, such rotary elements being provided with a rotary wedge or key for fixing an inserted retainer head on rotation of the rotary element. For fixing in place the connection blocks designed in this manner only have to be plugged together and then only fixed in relation to each other by twisting the rotary elements. It is thus possible to dispense with fastening screws, screws having been frequently employed with different lengths for arrangements of different lengths of connection blocks and such screws have to be suitable stored and made available. In the novel arrangement herein it is only necessary to provide, on the one hand, retainer elements which are of identical design and, on the other hand, identically produced rotary elements, which may readily be inserted in or slipped on the connection blocks or preassembled in place. Such a connection between the blocks is something which is significant in its own right and independent of the rest of the design of the conductor system.

The retainer elements are preferably designed to be screwed into the connection block, whereas the rotary elements are able to be inserted into suitable recesses in the connection block, which are arranged so as to be perpendicular to the openings, the outer side of the inserted rotary elements being generally flush with the outer face of the connection block so that there is a satisfactory abutting action between the two.

BRIEF DESCRIPTION OF THE DRAWINGS

Working embodiments of the invention will now be described in more detail with reference to the drawing and the ensuing account thereof.

DETAILED DESCRIPTION OF WORKING EMBODIMENTS OF THE INVENTION

Figure 1:
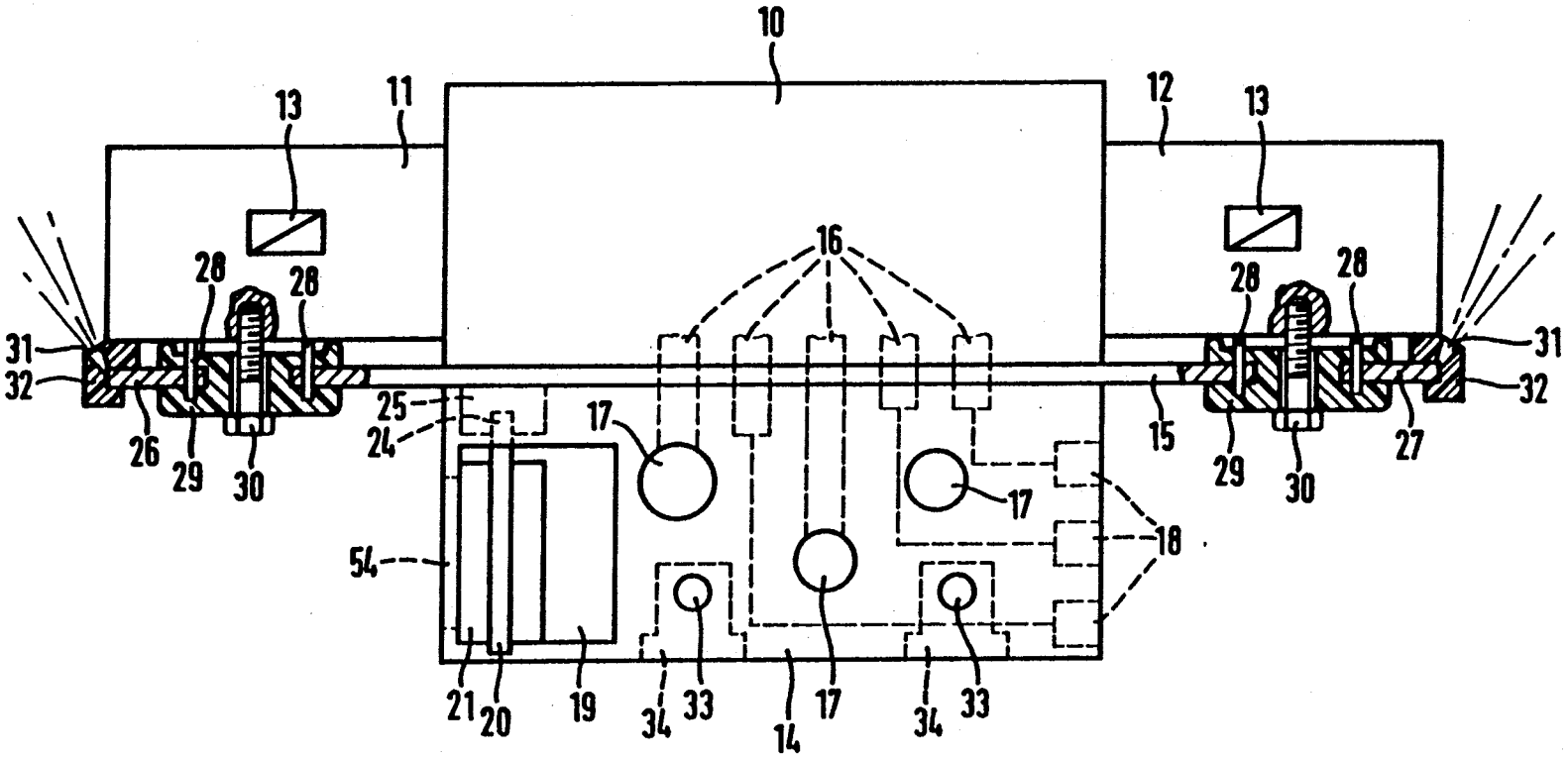
FIG. 1 is a lateral elevation of an embodiment of the invention in the form of a complete valve unit with two actuating blocks.

The valve unit illustrated in FIG. 1 is made up of a fluid power, i.e. pneumatic or hydraulic, valve block 10 with electromagnetic actuating blocks 11 and 12 mounted on the two opposite end faces of the valve block 10. In a conventional manner the blocks contain a diagrammatically indicated electromagnet winding 13 serving for the operation of a valve member, not shown, arranged in the valve block 10. In the case of the illustrated arrangement with two actuating blocks 11 and 12 it may for instance be a question of a pulse valve. It is naturally possible however to use other types of valves in the present case, as for instance valves only having one actuating block only.

The valve block 10 is mounted and secured to a connection block 14, there being a printed circuit board 15 arranged between the two of them and which will be described in more detail infra. All the necessary valve conductors 16 or ducts, of which five are shown diagrammatically in broken lines, extend from the connection block 14 to the valve block 10. Such conductors may amount to conventional compressed air lines or ducts, power lines, venting lines and control lines. Accordingly the printed circuit board 15 has openings corresponding thereto, which are sealed off. Some of these valve conductors 16 open into transverse ducts 17 of the connection block 14, which on assembly together of a plurality of connection blocks are aligned with each other. It is in this manner that it is possible for instance, for the supply of compressed air or possibly the venting of air, to take place in a uniform manner. The remaining conductors open at terminals 18 at the end side of the connection block 14, which for instance may be connected with power conductors leading to loads. The fitting together of valve blocks with such connection blocks may—with the exception of the printed circuit board 15—be conventional so that no detailed description is provided of the arrangement of fluid power conductor means, more especially because such arrangement is not in any way critical for the present invention.

In a further through passage 19 which is also transverse and is of larger size, a printed circuit board 20 is arranged having a female plug connector 21 so as to be aligned with the longitudinal direction of the said through passage 19 and which will be described in more detail later in connection with FIGS. 4 through 6. On assembly the connection blocks 14 to form a row running perpendicularly to the plane of FIG. 1 each end edge part, designed in the form of a multiple plug connector 22, of the printed circuit board 20 extend in a connection block 14 in to the female plug connector 21 of the next connection block so that the printed wiring 23 on the printed circuit boards 20 is continued into the further connection blocks, i.e. connected therewith.

The upper end part of the printed circuit board 20 is designed to constitute a male plug connector 24 and in the assembled state, see FIG. 1, fits into a female plug connector 25 on the lower side of the other printed circuit board 15, which is arranged to be normal to the printed circuit board 20. This leads to production of connections between the printed wiring 23 and printed wiring located on the printed circuit board 15. This printed wiring, which is not illustrated, on the printed circuit board 15 extends from the female plug connector 25 to both sides into the two end parts 26 and 27 projecting past the connection block 14, of the printed circuit board 15, which generally speaking fits under the actuating blocks 11 and 12.

Connection contact pins 28 extend from each of the two actuating blocks 11 and 12 downwards so that in the assembled state as shown in FIG. 1 the pins fit into suitable contact openings in the printed circuit board 15. These contact openings, which are not shown in detail, are connected with the printed circuit board so that the connection contact pins 28 are able to be connected via the female plug connector 25 with the wiring 23 on the printed circuit board 20 or are in fact connected therewith.

In order to protect the plug connection device consisting of the terminal contact pins 28 and the corresponding contact openings in the printed circuit board 15 against the penetration of moisture, liquid and dirt etc. and also against mechanical damage and to prevent the parts being touched, the part in question is in each case covered over by an elastomeric sealing element 29. This sealing element 29, which is in the form of a molding, is adapted to be plugged into a suitable opening in the printed circuit board 15 and serves at the same time as an elastic spacer to maintain the required distance from the actuating block 11. As a matter of principle it is possible for this sealing element 29 to be injected in place or it may be made of another insulating material . A retainer screw 30 extends through this sealing element 29 for securing the printed circuit board 15 on the actuating block 11 or, respectively, 12.

At the outer end parts of the printed circuit board 15 LEd's 31 are arranged, which are also connected, in a manner not shown, with the wiring on the printed circuit board 15 so that the respective switching state of the actuating blocks 11 and 12 and the presence of a control voltage for the same is indicated. The LED's 31 are also surrounded by a protective sealing element 32.

In a simplified form of the valve unit the valve block 10 may naturally have only one actuating block if desired. One of the projecting end parts 26 and, respectively, 27 of the printed circuit board 15 may then be omitted, i.e. the printed circuit board does not have to protect at both ends. The arrangement shown of the male plug contact means and the female connectors of the plug connection devices described may naturally also be reversed so that for instance the printed circuit board 15 may bear the connection terminal contact pins 28, which will then fit into corresponding contact openings in the actuating blocks.

Figure 2:
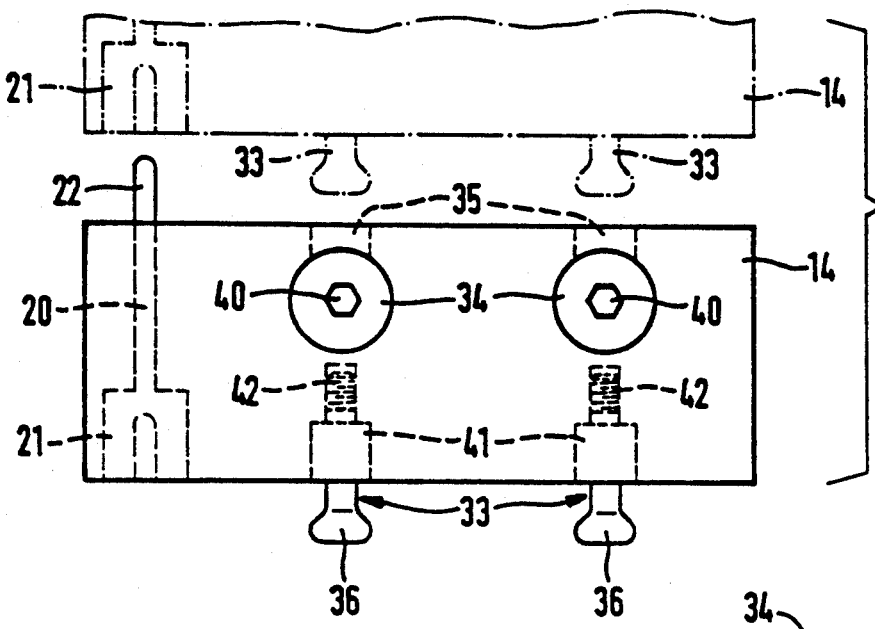
FIG. 2 is a view from below of a connection block.
Figure 3:
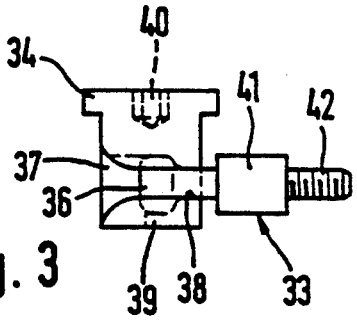
FIG. 3 shows a retainer element inserted into a rotary element.

In order to attach a plurality of connection blocks 14 together in a row use is made of retainer elements 33 and rotary elements 34 adapted to cooperate therewith and which will be explained in more detail with reference to FIGS. 2 and 3. In FIG. 2 the connection block 14 will be seen from below. At one side part the rotary elements 34, which are generally cylindrical in design, are fitted in a rotating manner in suitable openings in the connection block 14. In FIG. 2 it is a question of two rotary elements 34, but the number thereof is naturally not critical. Openings 35 extend from the openings for receiving the rotary elements 34 so as to be perpendicular to them and directed towards one side of the connection block 14, for receiving the respective retainer elements 33 of the next connection block 14 which is to be attached. On plugging such a further connection block 14 in place the retainer heads 36, which are made with a larger diameter, engage the free ends of the retainer elements 33, extending out of the connection block 14, and extend into these openings 35 and into the rotary elements 34. The rotary elements 34 have a slot 38 which extends from a suitable opening 37 and tapers in the circumferential direction. The slot 38 is formed by a rotary wedge 39. Since this rotary wedge 39 or key increases radially in diameter when such turning motion takes place, the respective inserted retainer head 36 is drawn in during the rotation and is locked by the tapering slot 38 so that a secure holding action is ensured. In order to ensure powerful torque transmission the rotary elements 34 have a hex socket 40 in their outwardly directed surface in order to receive a male hex wrench. It is naturally possible to use other wrenches together with other means for engagement thereof.

The retainer elements 33 are designed to be screwed into suitable openings of the connection block 34 opposite to the openings 35, the middle part with the larger diameter being designed in the form of a centering part 41, which is adjoined by a screw part 42. The centering part 41 is, in the screwed in state, aligned with the outer face of the connection block 14. The same applies for the outwardly directed surface of the rotary element 34, which is also aligned with the outer face of the connection block 14.

In FIG. 2 the connection block 14 will be seen in a state shortly before assembly with a further connection block shown in broken lines. In this view it will also be seen that the end edge part, designed as a multiple plug connector 22, of the printed circuit board 20 projects past the connection block 14 and thus is able to fit into the female plug connector 21 set in the next connection block. As a matter of principle this arrangement would be able to be reversed without any difficulty.

Figure 4:
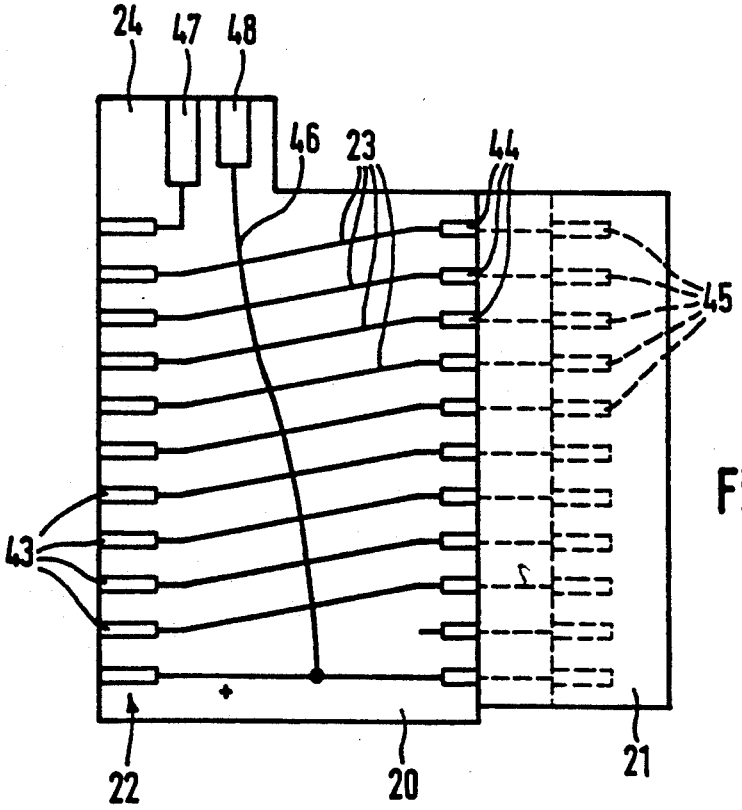
FIG. 4 shows a first working embodiment of a printed circuit board adapted to be inserted into a connection block with terminals, which have a fixed electrical association with each other.

The printed circuit board shown in FIG. 4 has—as indicated previously—a female plug connector 21 on one end edge part and at the opposite end edge part is in the form of a male multiple plug connector 22, which is able to be connected with a corresponding, female connector 21 on a further identical printed circuit board 20. For this purpose this male multiple plug connector 22 has a row of adjacently placed contact faces 43, also in the form of printed wiring, while at the opposite end edge part there is a corresponding number of contact faces 44 in the same arrangement. The contact faces 44 are in this respect connected with corresponding contact faces 45 in the female plug connector 21, which naturally may also be designed in the form of contact springs, contact tags or the like.

The lowermost contact face 43 is connected with the lowermost contact face 44 via a wire of the printed wiring 23. This part of the printed wiring 23 is connected with the potential of a terminal of the supply voltage, i.e. the power supply. Furthermore this lowermost printed wiring 23 is connected via a connecting wire 46 with a contact face 48 of the upper end part, designed in the form of a male plug connector 24, of the printed circuit board 20. The uppermost of the contact faces 43 is connected with a further contact face 47 of the male plug connector 24. The other contact faces 43 are so connected via the further printed wiring 23 with the opposite contact faces that in each case there is an offset by one contact face in an upward direction. This means that starting with a first printed circuit board 20 the uppermost contact face 43 is connected with the first actuating block, while the contact faces 43 located thereunder are connected with the second, third, fourth and so on actuating block etc. of the following valve units. This ensures that there is a definite association between the contact faces 43 of the first printed circuit board 20 with the actuating blocks of the overall arrangement and the contact faces 43 of this first printed circuit board 20 may be suitably connected. Further terminals and connection wiring are not needed.

Figure 5:
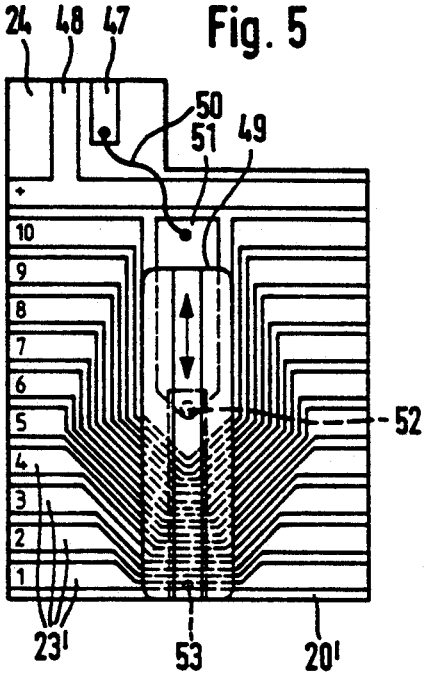
FIG. 5 shows a second working embodiment of the invention in the form such a printed circuit board with a slide switch for modifying the electrical association.

The further working embodiment of the invention shown in FIG. 5 as an example of such a printed circuit board 20' has a vertically moving slide switch 49. The wiring 23' extends in this case directly between opposite contact faces, which are not shown in this case in order to simplify the figure. These contact faces, just like the female plug connector 21, may be designed as in FIG. 4. In the case of this form of the invention the uppermost printed wiring 23', which receives the positive potential of the power supply, is connected with the contact face 48 of the male plug connector 24. The other contact face 47 of this male plug connector 24 is connected via a connecting wire 50 with a contact face 51, which is every setting of the switch is connected via a wiper contact 52 with the slide switch 49. A further wiper contact 43 connected in a conducting manner with the wiper contact 52 runs over the middle part of the printed wiring 23' when the slide switch is moved vertically 49. At this position the wiring is arranged in a compressed manner, that is to say the wires are placed close together. As a result every actuating block 11 and, respectively, 12 of a valve unit may be connected subsequently by operation of the slide switch 49 with one of the wires of the printed wiring 23', that is to say connected with any one of a number of control lines as may be desired. This makes possible subsequent modification of the wiring arrangement and of the conductor connections. For access to the slide switch 49, which is located on the printed circuit board 20' in the through passage 19 in the interior of the connection block 14, there is a suitable recess 54 on the respective end of the connection block 14. It is by way of this opening 54 that, given a suitable design of the arrangement, it is possible to replace the printed circuit boards without the valve unit having to be taken to pieces.

Figure 6:
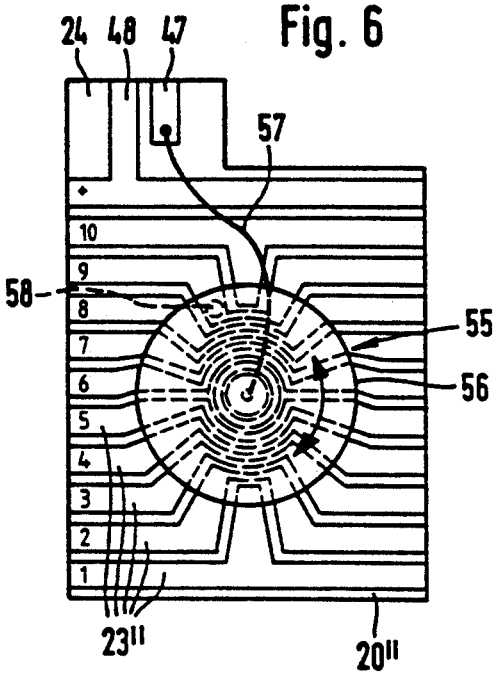
FIG. 6 depicts a third working embodiment of the invention in the form of such a printed circuit board with a rotary switch for modifying the electrical association.

The working embodiment of the invention shown in FIG. 6 in the form of a printed circuit board 20'' is designed in a manner similar to that of FIG. 5 and is also shown in a simplified manner, there being a rotary switch 55 in lieu of the slide switch 49. A rotary element 56 mounted on the printed circuit board 20'' in the center of this printed circuit board is connected via a connecting conductor 57 with the contact face 47 in a suitable manner. A wiper contact 58 on this rotary element 56 sweeps the individual wires of the printed wiring 23'' when rotation takes place. Adjacent to this rotary element 56 the printed wiring extends generally radially. It is in this manner that a greater variety of switching combinations are produced, as was indicated in the embodiment shown in FIG. 5.

Figure 7:
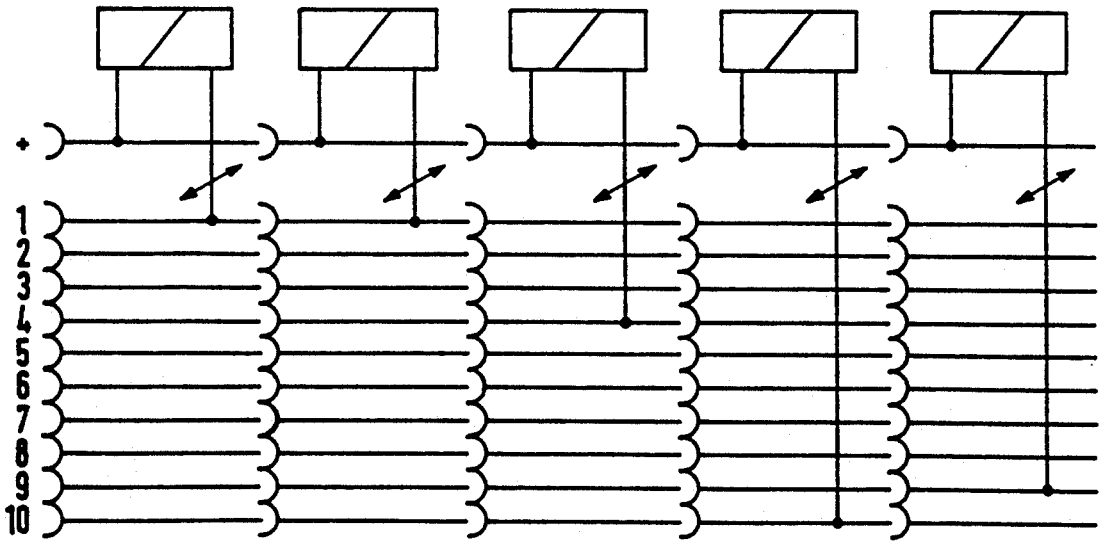
FIG. 7 is a diagrammatic circuit of printed circuit boards of actuating blocks connected with printed circuit boards in accordance with FIG. 5 or FIG. 6.

FIG. 7 shows the electrical connection together of five valve units in a schematic. As was the case with the other embodiments already described, in this case as well the printed circuit boards 20' (or 20'') connected in series via the plug connection devices 21 and 22 have ten switching wires of the printed wiring 23' (or 23''), and there is in addition the wiring continuously connected with the power supply. The electromagnet windings 13 of the actuating blocks 11 and, respectively, 12 on the one hand always connected via the slide switch 49 (or, respectively, the rotary switch 55) selectively with one of the other wires of the printed wiring.

If a valve unit as in FIG. 1 has two actuating blocks 11 and 12, as for instance for an pulse valve, the corresponding electromagnet windings may be put in parallel. It is however also possible to put such electromagnetic valve windings separately in circuit using a double slide switch.

The connecting conductors 46, 50 and 57 shown in FIGS. 4 through 6 may obviously also be in the form of printed wiring if it is suitably set out, or they may be in the form of printed wiring on the back side.

It is naturally possible to have other similar blocks in place of connection blocks for the connection of fluid power units by way of the connecting means as described.

The embodiments of the invention in which an exclusive property or privilege is claimed are defined as follows.

We claim:

1. A fluid power valve unit, comprising:

a valve block having plural fluid ports therein;

at least one electromagnetic actuating block mounted on said valve block and having at least one electromagnetic device thereon;

a connection block having plural fluid carrying ducts thereon provided in fluid communication with said plural fluid ports, and means defining a printed circuit board receiving opening therein;

a first printed circuit board and first printed circuit wiring thereon connected at one end in circuit with said electromagnetic device and at an opposite end to a plug connector device oriented in said printed circuit board receiving opening;

a second printed circuit board having second printed circuit wiring thereon separate from said first printed circuit wiring terminating in plural electrical connectors, said second printed circuit board being removably received in said printed circuit board receiving opening, a first of said electrical connectors on said second printed circuit board being coupled to said first plug connector device to thereby provide through said second printed circuit wiring an electrical connection of said plug connector other of said electrical connectors on first and second lateral edges of said second printed circuit board and thence said first printed circuit wiring and said electromagnetic device, said second printed circuit wiring including at least a first and a second electrical conductor extending between said first lateral edge and said second lateral edge, said electrical connectors along said second lateral edge being in a male plug form, said first electrical conductor being electrically connected to and extending between a second electrical connector at said first lateral edge and a third electrical connector at said second lateral edge directly across said second printed circuit board from said second electrical connector, said first electrical conductor being supplied from an electrical source with a potential of one power supply pole, said second electrical conductor being connected to and extending between a further electrical connector at said first lateral edge and a still further electrical connector at said second lateral edge offset by one space from being directly across from said further electrical connector at said first lateral edge, said second printed circuit wiring including a third conductor which is the only electrical conductor to extend directly between said first electrical connector and said second lateral edge.

2. A fluid power valve unit, comprising:

a valve block having plural fluid ports therein;

at least one electromagnetic actuating block mounted on said valve block and having at least one electromagnetic device thereon;

a connection block having plural fluid carrying ducts thereon provided in fluid communication with said plural fluid ports, and means defining a printed circuit board receiving opening therein;

a first printed circuit board and first printed circuit wiring thereon connected at one end in circuit with said electromagnetic device and at an opposite end to a plug connector device oriented in said printed circuit board receiving opening;

a second printed circuit board having second printed circuit wiring thereon separate from said first printed circuit wiring terminating in plural electrical connectors, said second printed circuit board being removably received in said printed circuit board receiving opening, a first of said electrical connectors on said second printed circuit board being coupled to said first plug connector device to thereby provide through said second printed circuit wiring an electrical connection of said plug connector device to other of said electrical connectors on a first and a second lateral edge of said second printed circuit board and thence said first printed circuit wiring and said electromagnetic device, said electrical connectors at said first lateral edge being oriented in a side-by-side array, said electrical connectors at said second lateral edge being also oriented side-by-side directly across said second printed circuit board from said electrical connectors at said first lateral edge, said second printed circuit wiring including plural electrical conductors, a first and a second electrical conductor each being connected to a one of said electrical connectors located at opposite ends of said side-by-side array of electrical connectors on said first lateral edge, said first electrical conductor extending from a said electrical connector on said first lateral edge to said first of said electrical connectors on said second printed circuit board and a further electrical connector on said second lateral edge, said second electrical conductor extending from said first lateral edge to an electrical connector at said second lateral edge.

3. The valve unit as claimed in claim 2, wherein remaining electrical conductors between said first and second electrical conductors at said first lateral edge extend across said second printed circuit board to said electrical connectors at said second lateral edge but offset by one position at least one of toward and away from said electrical connector connected to said first electrical conductor.

4. The valve unit as claimed in claim 2, wherein remaining electrical conductors between said first and second electrical conductors at said first lateral edge extend across said second printed circuit board to said electrical connectors at said second lateral edge, and wherein a multi-way switch device is provided on said second printed circuit board, wherein at least one of said remaining electrical conductors is connected in circuit with said multi-way switch device for facilitating a selective electrical connection of at least one of said remaining electrical conductors to said plug connector device.

5. The valve unit as claimed in claim 4, wherein said multi-way switch device is at least one of a linear slide switch and a rotary switch.

6. The valve unit as claimed in claim 5, wherein said printed circuit board receiving opening in said connection block includes means defining an access opening to facilitate access to the said multi-way switch device.

7. A fluid power valve unit, comprising:

a valve block having plural fluid ports therein;

at least one electromagnetic actuating block mounted on said valve block and having at least one electromagnetic device thereon;

a connection block having plural fluid carrying ducts thereon provided in fluid communication with said plural fluid ports, and means defining a printed circuit board receiving opening therein;

a first printed circuit board and first printed circuit wiring thereon connected at one end in circuit with said electromagnetic device and at an opposite end to a first plug connector device oriented in said printed circuit board receiving opening;

a second printed circuit board having second printed circuit wiring thereon separate from said first printed circuit wiring terminating in plural electrical connectors, said second printed circuit board being removably received in said printed circuit board receiving opening, a first of said electrical connectors on said second printed circuit board being coupled to said first plug connector device to thereby provide through said second printed circuit wiring an electrical connection of said first plug connector device to said electrical connectors on at least one of a first and a second lateral edge of said second printed circuit board and thence said first printed circuit wiring and said electromagnetic device, said electrical connectors at said second lateral edge being oriented in a side-by-side array an in a male plug form, said printed circuit board receiving opening including means for defining an opening for facilitating said male plug form to project from said connection block; and a further connection block and connection means for connecting said further connection block to said connection block, said further connection block having means defining a second plug connector device adapted to receive therein said male plug form.

8. The valve unit as claimed in claim 7, wherein said first printed circuit wiring is arranged on a board located between said valve block and said connection block and includes electrical conductors providing electrical connection to said electromagnetic device on said actuating block.

9. The valve unit as claimed in claim 7, wherein a second plug connector device is mounted on said second printed circuit board at said first lateral edge and said electrical connectors at said first lateral edge are embodied in said second plug connector device, and wherein said further connection block has a further printed circuit board thereon with a male plug form projecting outwardly therefrom adapted to be received in a still further plug connector device.

10. The valve unit as claimed in claim 9, wherein said first printed circuit wiring includes a receptacle connected in electrical circuit therewith, and wherein said actuating block includes a male plug form thereon received in said receptacle to provide electrical connection between said first printed circuit wiring and said electromagnetic device.

11. The valve unit as claimed in claim 10, wherein said receptacle on said first printed circuit wiring is surrounded by a sealing element, said sealing element being in the form of an elastomer.

12. The valve unit as claimed in claim 7, wherein said first printed circuit wiring includes at least one light producing element for indicating at least one of a switching state and a voltage state of said actuating block.

13. The valve unit as claimed in claim 12, wherein said light producing element is arranged on outer end parts of a further printed circuit board.

14. A fluid power valve unit, comprising:

a valve block having plural fluid ports therein;

at least one electromagnetic actuating block mounted on said valve block and having at least one electromagnetic device thereon;

a connection block having plural fluid carrying ducts thereon provided in fluid communication with said plural fluid ports, and means defining a printed circuit board receiving opening therein;

a first printed circuit board and first printed circuit wiring thereon connected at one end in circuit with said electromagnetic device and at an opposite end to a first plug connector device oriented in said printed circuit board receiving opening;

a second printed circuit board having second printed circuit wiring thereon separate from said first printed circuit wiring terminating in plural electrical connectors, said second printed circuit board being removably received in said printed circuit board receiving opening, a first of said electrical connectors on said second printed circuit board being coupled to said first plug connector device to thereby provide through said second printed circuit wiring an electrical connection between other of said electrical connectors on said second printed circuit board and said plug connector device and thence said first printed circuit wiring and said electromagnetic device; and a further connection block and connection means for connecting said further connection block to said connection block, wherein connecting means includes on one side of said further connection block projecting retainer elements having a retainer head, and a side of said connecting block opposing said one side of said further connection block having openings to receive therein corresponding retainer elements of said further connection block, said openings terminating at rotary elements in said connection block, such rotary elements being provided with a rotary wedge means for facilitating a securing of said retainer head received in said opening on rotation of said rotary element.

15. The valve unit as claimed in claim 14, wherein said retainer elements are screwed into said further connection block.

16. The valve unit as claimed in claim 14, wherein said rotary elements are inserted into corresponding recesses in said connection block, axes of which recesses are arranged perpendicular to axes of said openings, and wherein outer exposed ends of said rotary elements are substantially flush with an outer face of said connection block.

17. A fluid power valve unit, comprising:

a valve block having plural fluid ports therein;

at least one electromagnetic actuating block mounted on said valve block and having at least one electromagnetic device thereon;

a connection block having plural fluid carrying ducts thereon provided in fluid communication with said plural fluid ports, and means defining a printed circuit board receiving opening therein;

electrical wiring means connected at one end in circuit with said electromagnetic device and at opposite end to a first plug connector device oriented in said printed circuit board receiving opening;

a printed circuit board having printed circuit wiring therein terminating in plural electrical connectors, some of said plural electrical connectors being provided at first and second lateral edges of said printed circuit boards, said printed circuit board being removably received in said printed circuit board receiving opening, a first of said electrical connectors on said printed circuit board being coupled to said first plug connector device to thereby provide through said printed circuit wiring an electrical connection of said first plug connector device and said electrical connectors on said first and said second lateral edges of said printed circuit board and thence said electrical wiring means and said electromagnetic device, said electrical connectors at said first lateral edge being oriented in a side-by-side array, said electrical connectors at said second lateral edge being also oriented side-by-side directly across said second printed circuit board from said electrical connectors at said first lateral edge, said second printed circuit wiring including plural electrical conductors, a first and a second electrical conductor each being connected to a one of said electrical connectors located at opposite ends of said side-by-side array of electrical connectors on said first lateral edge, said first electrical conductor extending from a said electrical connector on said first lateral edge to said first of said electrical connectors on said printed circuit board and a further electrical connector on said second lateral edge, said second electrical conductor extending from said first lateral edge to a still further electrical connector at said second lateral edge, said side-by-side electrical connectors on said first and second lateral edges being arranged on opposite edges of said printed circuit board, with one of said side-by-side electrical connectors being in the form of a multiple contact male plug connector and the other being in the form of a multiple contact female plug connector.

18. The valve unit as claimed in claim 17, wherein remaining electrical conductors between said first and second electrical conductors at said first lateral edge extend across said second printed circuit board to said electrical connectors at said second lateral edge but offset by one position at least one of toward and away from said electrical connector connected to said first electrical conductor.

19. The valve unit as claimed in claim 17, wherein remaining electrical conductors between said first and second electrical conductors at said first lateral edge extend across said second printed circuit board to said electrical connectors at said second lateral edge, and wherein a multi-way switch device is provided on said second printed circuit board, wherein at least one of said remaining electrical conductors is connected in circuit with said multi-way switch device for facilitating a selective electrical conductors to said first plug connector device.

20. The valve unit as claimed in claim 19, wherein said multi-way switch device is at least one of a linear slide switch and a rotary switch.

21. The valve unit as claimed in claim 20, wherein said printed circuit board receiving opening in said connection block includes means defining an access opening to facilitate access to the said multi-way switch device.

22. The valve unit as claimed in claim 17, wherein a second plug connector device is mounted on said second printed circuit board at said first lateral edge and said electrical connectors at said first lateral edge are embodied in said second plug connector device, and wherein said further connection block has a further printed circuit board thereon with a male plug form projecting outwardly therefrom adapted to be received in a still further plug connector device.

23. A fluid power valve unit, comprising:

a valve block having plural fluid ports thereon;

at least one electromagnetic actuating block mounted on said valve block and having at least one electromagnetic device thereon;

a connection block having plural fluid carrying ducts thereon provided in fluid communication with said plural fluid ports, and means defining a printed circuit board receiving opening therein;

electrical wiring means connected at one end in circuit with said electromagnetic device and at an opposite end to a first plug connector device oriented in said printed circuit board receiving opening;

a printed circuit board having printed circuit wiring thereon terminating in plural electrical connectors, said printed circuit board being removably received in said printed circuit board receiving opening, a first of said electrical connectors on said printed circuit board being coupled to said first plug connector device to thereby provide through said printed circuit wiring an electrical connection of said first plug connector device and said electrical connectors on two lateral edges of said printed circuit board and thence said electrical wiring means and said electromagnetic device, said electrical connectors on said two lateral edges being arranged side-by-side said two lateral edges being on opposite edges of said printed circuit board, with one set of said side-by-side electrical connectors on one lateral edge being in the form of a multiple contact male plug connector and an other set on an other lateral edge being in the form of a multiple contact female plug connector; and a further connection block and connecting means for connecting said further connection block to said connection block, said further connection block having means defining a second plug connector device adapted to receive therein said male plug connector.

* * * * *

UNITED STATES PATENT AND TRADEMARK OFFICE

CERTIFICATE OF CORRECTION

PATENT NO. : 5 234 033

DATED : August 10, 1993

INVENTOR(S) : Kurt STOLL et al.

It is certified that error appears in the above-identified patent and that said Letters Patent is hereby corrected as shown below:

Column 9, line 46; delete "first".
line 49; after "connector" insert ---to---.
Column 10, line 29; delete "first".
Column 11, line 44; change "an" to ---and---.
line 45; delete "for".
line 48; change "connection" (2nd occurrence) to ---connecting---.
Column 12, line 32; delete "first".
line 41; delete "first".
line 48; change "connection" (2nd occurrence) to ---connecting---.
line 50; after "wherein" insert ---said---.

UNITED STATES PATENT AND TRADEMARK OFFICE

CERTIFICATE OF CORRECTION

PATENT NO. : 5,234,033

DATED : August 10, 1993

INVENTOR(S) : Kurt Stoll, et. al.

It is certified that error appears in the above-indentified patent and that said Letters Patent is hereby corrected as shown below:

Column 13, line 14; after "at" insert ---an---.
line 21; change "boards," to ---board,---.
Column 14, line 7; after "electrical" inert ---connection of at least one of said remaining electrical---.

Signed and Sealed this

Fifth Day of April, 1994

Bruce Lehman

*Attest:*

BRUCE LEHMAN

*Attesting Officer*

*Commissioner of Patents and Trademarks*